US006229414B1

(12) United States Patent
Toyama et al.

(10) Patent No.: US 6,229,414 B1
(45) Date of Patent: May 8, 2001

(54) MAKE-AND-BREAK MECHANISM FOR CIRCUIT BREAKER

(75) Inventors: Kentaro Toyama, Kanagawa; Naoshi Uchida, Saitama; Tatsunori Takahashi, Saitama; Koji Nomura, Saitama; Katsunori Kuboyama, Saitama; Koji Asakawa, Saitama; Takumi Fujihira, Saitama; Hisao Kawata, Saitama; Hiroaki Tosaka, Saitama, all of (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/631,478

(22) Filed: Aug. 3, 2000

(51) Int. Cl.[7] ..... H01H 73/12; H01H 75/00; H01H 77/00

(52) U.S. Cl. ..... 335/17; 335/21; 335/167

(58) Field of Search ..... 335/6, 7, 15, 21, 335/17, 22, 23, 167–171, 172–176

(56) References Cited

U.S. PATENT DOCUMENTS 5,923,261 * 7/1999 Castonguay et al. ..... 340/638

* cited by examiner

*Primary Examiner*—Ramon M. Barrera

(74) *Attorney, Agent, or Firm*—Pearne & Gordon LLP

(57) ABSTRACT

In a make-and-break mechanism for use in a circuit breaker, an alarm output plate 56, which is disposed so as to be slidable in the vertical direction along the frame (cover plate) 27 of the make-and-break mechanism, is secured to the engaging projection 27*d* of the cover plate 27 through a pair of right and left guide holes 57 formed therein. At the same time, one end of a handle spring 59, which, in the trip operation, is used to rotate an operation handle 26 to a trip display position, is caught on the alarm output plate 56. In case where a latch receiver 47 is driven or rotated by the overcurrent detect portion of the make-and-break mechanism and the secured condition of a latch is thereby removed, the electric circuit of the circuit breaker is broken due to the stored energy of a main spring 64 and, in this case, the alarm output plate 56 is driven or slided in the lateral direction and thus the secured condition of the alarm output plate 56 is removed, so that the alarm output plate 56 is driven in the upward direction due to the spring force of the handle spring 59 to thereby operate an alarm contact.

3 Claims, 5 Drawing Sheets

MAKE-AND-BREAK MECHANISM FOR CIRCUIT BREAKER

BACKGROUND OF THE INVENTION

1. Field of the Invention

The present invention relates to a circuit breaker which is used to make and break a low voltage circuit or protect such low voltage circuit and, in particular, to a make-and-break mechanism for making and breaking the contact of a movable contact member.

2. Description of the Related Art

Conventionally, as a make-and-break mechanism of the above type for use in a circuit breaker, there is known a make-and-break mechanism which comprises: an operation handle rotatably supported on a frame composed of a cover plate and a back plate through a handle shaft; a make-and-break lever rotatably supported on a case through a make-and-break shaft and energized in one direction by a main spring; a mechanism member for transmitting the operation of the operation handle to the make-and-break lever; a latch having one end connected to the operation handle through the above handle shaft; a U-shaped pin disposed so as to bridge over the latch and mechanism member; and, a latch receiver rotatably supported on the above frame through a fulcrum shaft and, in the on state of the make-and-break mechanism, capable of securing the other end of the latch, wherein, in case where the secured condition of the latch by the latch receiver is removed due to the operation of an overcurrent detect portion of the make-and-break mechanism (a trip operation), the make-and-break lever is driven to an off position due to the stored energy of the main spring to thereby break the contact of a movable contact member, and, during this operation, that is, during the trip operation, an alarm output plate, which is disposed in the make-and-break mechanism so as to slide along the cover plate, is moved upwardly from a wait position to thereby operate an alarm contact.

Now, FIG. 7 is a front view of a conventional make-and-break mechanism including the above-mentioned alarm output plate, showing the on state thereof. In FIG. 7, although the alarm output plate 56 is energized upwardly by an output plate spring 70 consisting of a tension spring interposed between the alarm output plate 56 and a cover plate 27 consisting of the support frame of the make-and-break mechanism, the engaging portion 56*a* of the alarm output plate 56 is secured by a latch receiver 47 for securing a latch 34, whereby the alarm output plate 56 is held at a wait position shown in FIG. 7. The latch receiver 47 is rotatably supported on the support frame of the make-and-break mechanism through a projecting shaft 47*a* formed integral with the latch receiver 47 in the right and left direction and is energized clockwise by a return spring 50 which is inserted between the latch receiver 47 and cover plate 27.

Also, in FIG. 7, between the cover plate 27 and a pin 39 which connects an operation handle 26 to the mechanism member 36 of the make-and-break mechanism, there is provided a handle spring 59 which consists of a tension spring, while the operation handle 26 is energized clockwise. Further, an accessory linking plate 71 is guided to and held by the cover plate 27 in such a manner that it can be slided in the right and left direction, while the leading end of the accessory connecting plate 71 is opposed to the latch receiver 47. Between the accessory linking plate 71 and cover plate 27, there is provided a return spring 72 consisting of a tension spring.

The structure and operation of the make-and-break mechanism shown in FIG. 7 are substantially the same as those of the present invention which will be described hereinafter, and thus the detailed structure and operation thereof will be given through the detailed description of a mode for carrying out the present invention. That is, here, description will be given below of the trip operation of the make-and-break mechanism shown in FIG. 7. In the on state shown in FIG. 7, in case where an overcurrent flows in a circuit breaker, an overcurrent detect portion (not shown) is operated to push the upper end of the latch receiver 47 in the left direction, thereby rotating the projecting shaft 47*a* thereof counterclockwise. This removes the secured condition of the latch 34 by the latch receiver 47. As a result of this, a make-and-break lever 25 rotatably supported on the case through a make-and-break shaft 24 is driven or rotated due to the energy that is stored in a main spring 64, which breaks the contact of a movable contact member (not shown) (that is, trip operation). At the same time, the operation handle 26 rotatably supported by a handle shaft 31 is driven or rotated clockwise by the spring force of the handle spring 59, so that the operation line of the handle spring 59 stops at a position passing through the center of the handle shaft 31. This position is a trip display position and, at this position, the operation handle 26 is held in the horizontal attitude. This horizontal attitude of the operation handle 26 shows the generation of the trip operation.

Also, due to the above-mentioned rotation of the latch receiver 47, the secured position of the alarm output plate 56 is also removed at the same time and thus the alarm output plate 56 is moved upwardly by the spring force of the output plate spring 70. As a result of this, an alarm contact (not shown), which is disposed so as to be operated in linking with the alarm output plate 56, is operated, so that a trip signal is issued to the outside. On the other hand, in case where the accessory linking plate 71, which is used to operate or turn off the circuit breaker remotely by a voltage trip device, is pushed in the right direction against the return spring 72 by the voltage trip device (not shown), the latch receiver 47 is driven or rotated counterclockwise, which, similarly to the above-mentioned case, breaks the contact of the movable contact member.

In the above-mentioned make-and-break mechanism, conventionally, the alarm output plate 56 is normally secured by the latch receiver 47 and, at the same time, in the trip operation, the alarm output plate 56 is moved from the wait position by the output plate spring 70. Because of this, to the latch receiver 47, there are applied a load from the latch 34 as well as a load from the alarm output plate 56, which, in the trip operation, requires a large load force to drive or rotate the latch receiver 47. This leads to the increased size of the overcurrent detect portion as well as makes it easy to cause variations in the tripping characteristic. Also, the alarm output plate 56 requires an exclusive member, that is, the output plate spring 70; and, further, there are necessary another exclusive members which are used when an off operation is carried out by the voltage trip device, that is, the accessory linking plate 71 and its return spring 72. That is, the conventional make-and-break mechanism requires a large number of parts.

SUMMARY OF THE INVENTION

The present invention aims at eliminating the drawbacks found in the conventional make-and-break mechanism. Accordingly, it is an object of the invention to provide a make-and-break mechanism for use in a circuit breaker which not only can relieve the load of a latch receiver but also can reduce the number of parts necessary around an alarm output plate to thereby simplify the structure of the make-and-break mechanism.

In attaining the above object, according to the invention, there is provided a make-and-break mechanism for use in a circuit breaker in which the alarm output plate is secured to the frame of the make-and-break mechanism and, in the trip operation of the make-and-break mechanism, the secured condition of the alarm output plate is removed using the stored energy of the main spring, whereby the load to be applied to the latch. receiver can be relieved and, at the same time, the alarm output plate is moved using the handle spring used to the operation handle to the trip display position to thereby omit the output plate spring that is conventionally used.

That is, the invention is characterized in that, in the cover plate, there are provided a pair of right and left engaging projections and, in the alarm output plate, there are formed inverted-L-shaped guide holes which can be slidably fitted with these engaging projections; between a pin for connecting the operation handle to the mechanism member and the alarm output plate, there is provided a handle spring composed of a tension spring; in the on/off state of the make-and-break mechanism, the shoulder portions of the guide holes are engaged with the engaging projections to thereby hold the alarm output plate at a wait position; and, in the on state of the make-and-break mechanism, in case where the secured condition of the latch is removed, the alarm output plate is pushed by the U-shaped pin operatable in linking with the latch to thereby remove the above-mentioned engagement, whereby the alarm output plate is moved in the upward direction along the guide holes due to the spring force of the handle spring and, at the same time, the operation handle is rotated to a trip display position (Claim 1).

In the above make-and-break mechanism, in the operation handle, there is provided a projection opposed to the upper end face of the alarm output plate, the operation handle rotated to the trip display position is operated or rotated to an off position to thereby engage the latch with the latch receiver again and, during this operation, the alarm output plate is pressed down by the above projection to thereby engage the alarm output plate with the engaging projections again; that is, simultaneously with the resetting of the latch, the alarm output plate can be reset (Claim 2).

Also, in the above make-and-break mechanism, in latch receiver, there is provided a linking piece projecting in the lateral direction; in the alarm output plate, there is formed a power transmission portion which, in case where the alarm output plate moved in the upward direction along the guide holes with the latch receiver securing the latch, interferes with the linking piece of the latch receiver through the inclined surface of the power transmission portion; and, by operating or sliding the alarm output plate in the lateral direction using a voltage trip device to thereby remove the above-mentioned engagement, the linking piece of the latch receiver is pushed by the alarm output plate moving upwardly due to the spring force of the handle spring through the inclined surface of the power transmission portion, whereby the secured condition of the latch by the latch receiver is removed to thereby break the contact of the movable contact member. Due to this, the alarm output plate can also be used as an accessory linking plate so that the accessory linking plate and a return spring for the accessory linking plate can be omitted.

BRIEF DESCRIPTION OF THE DRAWINGS

FIGS. 5A to 5C are front views showing the make-and-break mechanism shown in FIG. 1, explaining the operation thereof; specifically, in which FIG. 5A shows the on state of the make-and-break mechanism;

FIG. 5B shows the off state thereof; and,

FIG. 5C shows the trip state thereof, respectively;

DETAILED DESCRIPTION OF THE PREFERRED EMBODIMENTS

Figure 1:
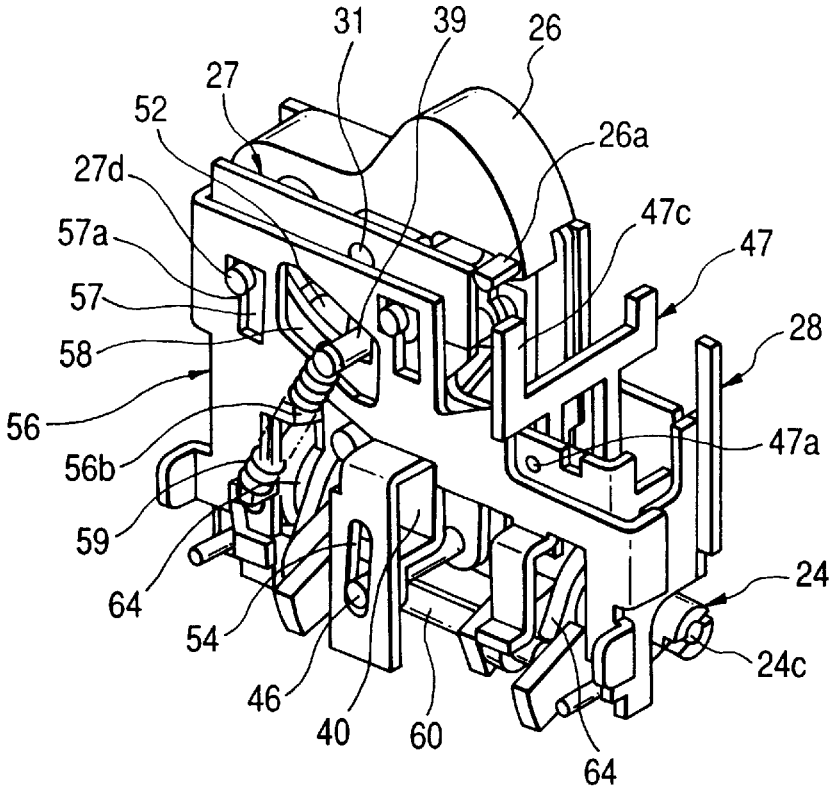
FIG. 1 is a perspective view of the whole structure of a make-and-break mechanism according to a mode for carrying out the invention.

Now, description will be given below of a mode for carrying out the. invention with reference to FIGS. 1 to 6. At first, FIG. 6 is a longitudinal section view of a circuit breaker incorporating therein a make-and-break mechanism according to the invention, showing the on state thereof. In FIG. 6, to the middle stage of a case 1, there are fixed a pair of front and rear fixed contact members 2 and 3 with their respective poles arranged in parallel to each other; and, against the respective lower surfaces of the fixed contact members 2 and 3, there is pressed a movable contact member 4, which bridges over the fixed contact members 2 and 3, by a contact spring 5 composed of a compression spring. And, to the mutual contact portions between the fixed contact members 2, 3 and movable contact member 4, there are connected fixed and movable contacts, respectively.

On the left (in FIG. 6) end of the case 1, there is disposed a power-source-side terminal 6 in such a manner that it is connected integrally with the fixed contact member 2. Also, on the right end of the case 1, there is disposed a load-side terminal 7, while the terminal 7 is connected to the fixed contact member 3 through an electromagnet device 8 and an over-load current detector device 9 which cooperate together in forming an overcurrent detect portion. The over-load current detector device 9 is composed of a bimetal 11, which is supported in an erect manner by a bimetal support 10 formed of a conductive plate, and a heater conductor 12 wound spirally around the periphery of the bimetal 11; and, the lower end portion of the heater conductor 12 is connected to the fixed contact member 3, while the upper end portion thereof is connected to the bimetal 11.

The electromagnet device 8 is structured as follows: that is, inside a U-shaped yoke 13, there is disposed an electromagnetic coil 15 wound around a hollow tubular-shaped bobbin 14; a fixed iron core 16 is formed integral with the yoke 13; a cylindrical-shaped plunger 17 is slidably inserted into the bobbin 14 in such a manner that it is opposed to the fixed iron core 16; between the fixed iron core 16 and plunger 17, there is interposed a return spring 18 which is composed of a compression spring; and, a push rod 19, which is composed of a round rod member, is penetrated through the fixed iron core 16 and yoke 13 in such a manner that it can be moved in the vertical direction. The movable contact member 4 is guided and held by a holder 20 so as to be slidable in the vertical direction, while the holder 20 is composed of insulation material (resin) with three poles thereof formed as an integral body. And, the push rod 19 is slidably penetrated through the holder 20, while the leading end of the push rod 19 is butted against the upper surface of the movable contact member 4.

Before and behind the movable contact member 4, there are disposed arc extinguish chambers 21 respectively; while there is. installed a commutation plate 22 composed of a conductive band-shaped member in such a manner that it bridges over the two extinguish chambers 21. The movable contact member 4 can be driven in such a manner that the contact of the movable contact member 4 can be make and broken due to the make-and-break operation of a make-and-break mechanism 23 as well as the contact of the movable contact member 4 can be broken due to the trip operation of the make-and-break mechanism 23. That is, while the internal structure of the make-and-break mechanism 23 will be described later, the make-and-break mechanism 23 includes a make-and-break lever 25 which can be rotated about a make-and-break shaft 24; and, in case where an operation handle 26 is operated to turn off from the shown on state thereof, the make-and-break lever 25 is rotated clockwise to press down the movable contact member 4 through the holder 20 against the contact spring 5, thereby opening a circuit between the two fixed contact members 2, 3. On the other hand, in case where the secured condition of a latch (not shown) included in the make-and-break mechanism 23 is removed through a power transmission mechanism (not shown) due to the operation of the electromagnet device 8 or over-load current detector device 9, the make-and-break lever 25 is driven clockwise due to the release of the energy that is stored in the main spring, thereby pressing down the movable member 4, with the result that the circuit between the two fixed contact members 2, 3 is opened.

Figure 2:
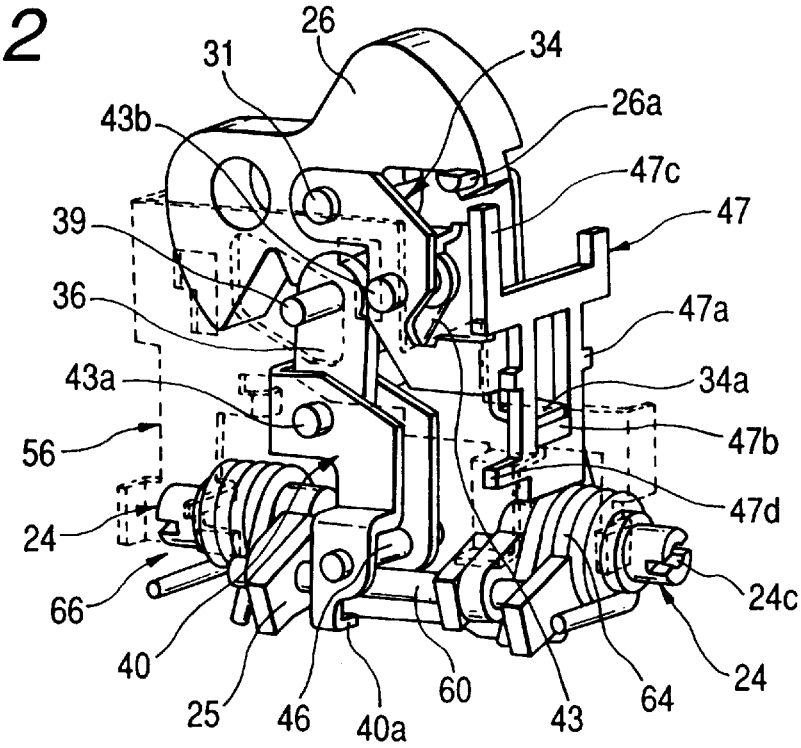
FIG. 2 is a perspective view of the make-and-break mechanism shown in FIG. 1, with a cover plate and a back plate removed therefrom.
Figure 3:
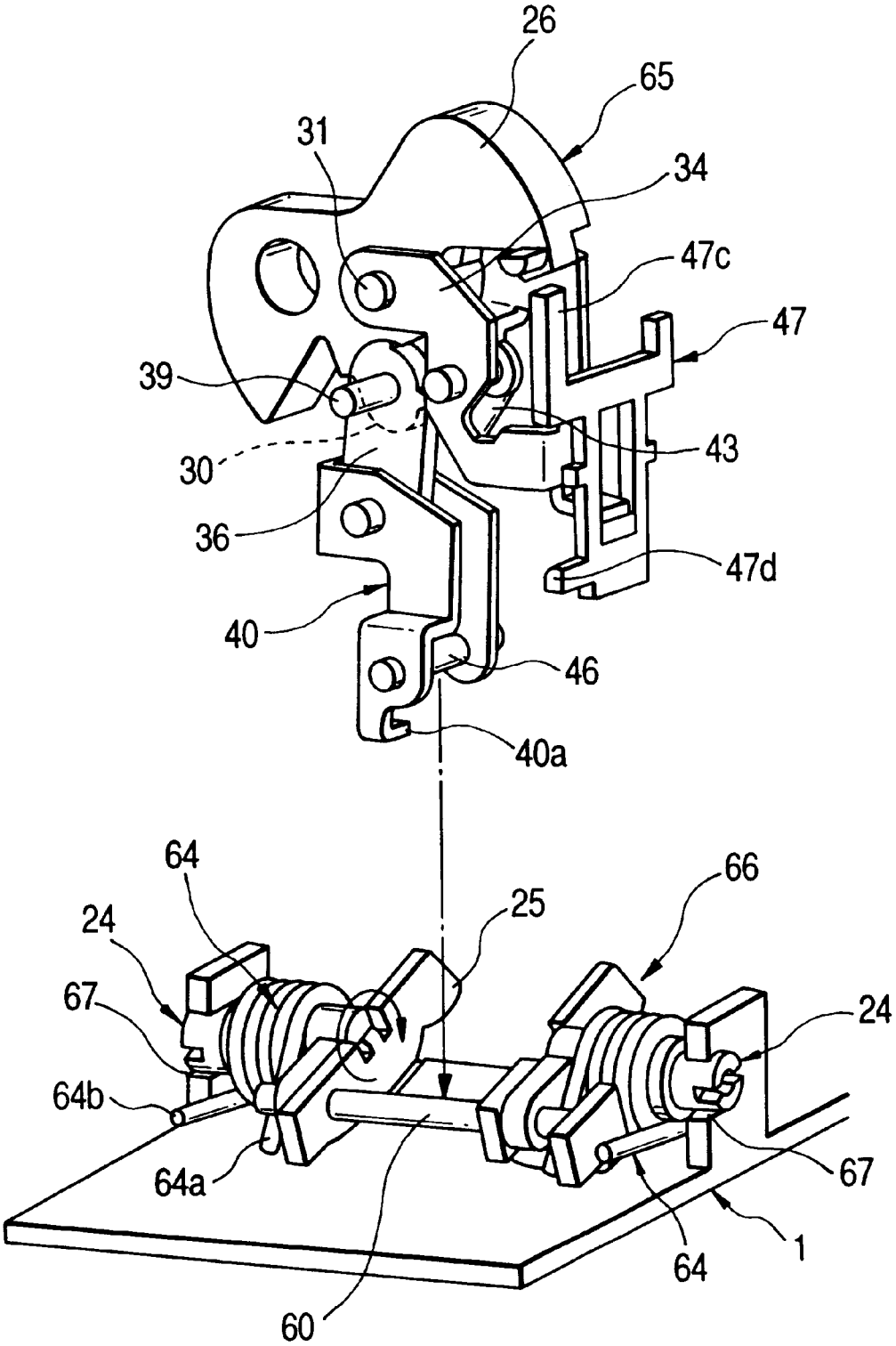
FIG. 3 is a perspective view of the make-and-break mechanism, showing a state thereof in which an operation portion and a make-and-break portion are separated from each other.
Figure 4:
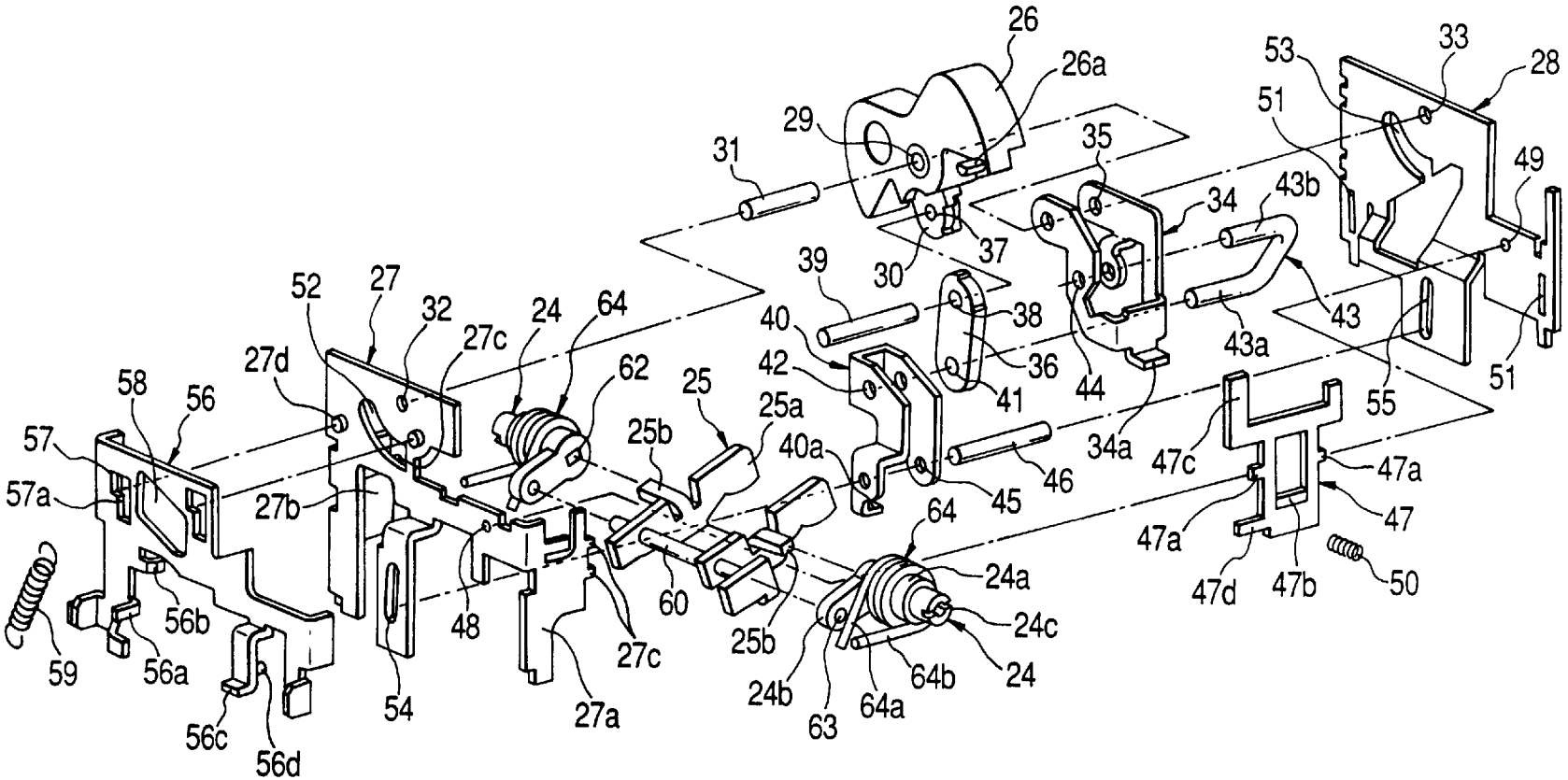
FIG. 4 is an exploded perspective view of the make-and-break mechanism shown in FIG. 1.

Now, FIGS. 1 to 4 are respectively perspective views of the structure of the make-and-break mechanism 23. specifically, FIG. 1 is a perspective view of the whole structure of the make-and-break mechanism 23, FIG. 2 is a perspective view of the structure of the make-and-break mechanism 23 with a cover plate and a back plate removed therefrom, FIG. 3 is a perspective view of the structure of the make-and-break mechanism 23 with an operation portion and a make-and-break portion separated from each other, and FIG. 4 is an exploded perspective view of the whole structure of the make-and-break mechanism 23. In FIGS. 1 to 4, especially, in FIG. 1, the make-and-break mechanism 23 includes the cover plate 27 and back plate 28, while the operation portion of the make-and-break mechanism 23 to be described below is supported by the cover plate 27 and back plate 28. At first, reference character 26 designates an operation handle which includes a bearing hole 29 formed in the center thereof and a downwardly facing link lever 30 mounted on the rather-near-to-one-side portion thereof and formed integral therewith. The operation handle 26 further includes a projection 26*a* for resetting an alarm output plate to be described later, while the projection 26*a* has a semi-circular section and is formed integral with the operation handle 26. The thus-structured operation handle 26 is rotatably supported through a handle shaft 31 to be inserted into the bearing hole 29 by the cover plate 27 and back plate 28 respectively including holes 32 and 33 into which the two ends of the handle shaft 31 can be fitted respectively. In this case, the handle shaft 31 is also simultaneously inserted into. a hole 35 formed in a latch 34 to be mounted on the operation handle 26, while the latch 34 is rotatably connected to the operation handle 26 through the handle shaft 31.

To the link lever 30 of the operation handle 26, there is rotatably connected one end of a link 36 through a pin 39 which is inserted into holes 37 and 38 respectively formed in the link lever 30 and the link 36. The link lever 30 and the link 36 cooperate together in forming a toggle joint. To the other end of the link 36, there is rotatably connected a power transmission plate 40 through a U-shaped pin 43 with one end 43*a* thereof to be inserted into holes 41 and 42 respectively formed in the link 36 and in the power transmission plate 40. On the other hand, the other end 43*b* of the U-shaped pin 43 is inserted into a hole 44 formed in the latch 34, whereby the U-shaped pin 43 connects together the latch 34 and link 36. Into the power transmission plate 40, there is mounted a power transmission shaft 46 through a hole 45 formed in the power transmission plate 40. Also, the power transmission plate 40 is forked so as to include two legs, while one leg is bent so as to have a hook-shaped portion 40*a*.

Now, reference character 47 stands for a latch receiver whose two projecting shafts 47*a*, 47*a* are respectively fitted into. the holes 48 and 49 of the cover plate 27 and back plates 28 in such a manner that they are rotatably supported on the cover plate 27 and back plates 28. Between the lower end portion of the latch receiver 47 and the bent portion 27*a* of the cover plate 27, there is inserted a return spring 50 which is composed of a compression coil spring 50. Along the lower edge of a square hole opened up in the latch receiver 47, there is formed an engaging portion 47*b*, while a bent formed pawl 34*a* in the latch 34 is secured to the engaging portion 47*b*. Also, in the latch receiver 47, there is integrally formed a rod-shaped connecting piece 47*d* in such a manner that it projects laterally of the latch receiver 47. In the case of the cover plate 27 and back plates 28 which support the above-mentioned portions of the make-and-break mechanism 23, a pair of upper and lower projections 27*c* respectively formed in the right and left bent portions 27*a* and 27*b* of the cover plate 27 are respectively fitted through elongated holes 51 respectively formed in the right and left portions of the back plate 28 so as to correspond to the upper and lower projections 27*c* and the leading ends of the upper and lower projections 27*c* are then caulked, whereby the cover plate 27 and back plates 28 are connected together as an integral body.

In the cover plate 27 and back plate 28, there are formed arc-shaped elongated holes 52 and 53 respectively which, when the operation handle 26 is rotated with the handle shaft 31 as a fulcrum thereof, extend along a locus to be drawn by the pin 39 provided on the leading end of the link lever 30; and, the two ends of the pin 39 are loosely inserted into the elongated holes 52 and 53. Also, in the cover plate 27 and back plate 28, there are respectively formed another elongated holes 52 and 53 which stand up somewhat obliquely, while the two ends of the power transmission shaft 46 are slidably inserted into the elongated holes 54 and 55.

Here, reference character 56 designates an alarm output plate which is disposed on the outside of the cover plate 27 in such a manner that a pair of right and left cylindrical-shaped engaging projections 27*d* provided on the cover plate 27 are slidably fitted into a pair of right and left inverted-L-shaped guide holes 57 formed in the alarm output plate 56, respectively. In the alarm output plate 56, there is opened up a window opening 58 having a parallelogram shape, and there is bent formed a spring catch piece 56*a*; between the end portion of the pin 39 projecting out through the window opening 58 and the spring catch piece 56*a*, there is provided a handle spring 59 and thus the alarm output plate 56 is energized upwardly by the handle spring 59; and, in the on/off states of the make-and-break mechanism 23, the shoulder portion 57*a* of the guide hole 57 is engaged with the engaging projection 27*d* so that the alarm output plate 56 is held in the shown wait position thereof. Also, in the alarm output plate 56, there is bent formed a butting piece 56*b*; and, in the on state of the make-and-break mechanism 23, the end portion 43*a* of U-shaped pin 43 is opposed to the butting projection 56*b*. Further, in the alarm output plate 56, there is bent formed an output projection portion 56*c* which is used to switch an alarm contact (not shown). Still further, on the back surface of the output projection portion 56*c*, there is disposed a power transmission portion 56*d* (FIG. 4) consisting of a rod-shaped body having a fan-shaped section, which, in case where the alarm output plate 56 moves in the upward direction along the guide holes 57 in a state where the latch receiver 47 securing the latch 34, interferes with the linking piece 47*d* of the latch receiver 47 through the inclined surface of the alarm output plate 56.

In FIG. 4, a make-and-break lever 25 is composed of a pair of right and left lever arms 25*a* which are connected to each other, and further includes a pair of projections 25*b* which are disposed on the two sides of the lever 25 so as to extend in the right and left direction. To the rear end portions of the lever arms 25*a*, there is mounted a connecting shaft 60 so as to penetrate through the rear end portions of the lever arms 25*a*. On the other hand, reference character 24 designates a pair of right and left make-and-break shafts; each make-and-break shaft 24 is composed of a stepped shaft portion 24*a* and an arm portion 24*b* formed at one end of the shaft portion 24*a*; and, in the inner end center of the shaft portion 24*a*, there is formed a hole 62 which corresponds to the projection 25*b* of the make-and-break lever 25 and extends in the axial direction of the shaft portion 24*a* and, in the leading end portion of the arm portion 24*b*, there is opened up a hole 63. Further, in the outer end of the shaft portion 24*a*, there is formed a power transmission groove 24*c* which extends in the diameter direction of the shaft portion 24*a*. On the large diameter portion of the shaft portion 24*a*, as shown in FIGS. 1 to 4, there is mounted a main spring 64 which is composed of a torsion spring. The thus structured make-and-break shafts 24 are mounted on the make-and-break lever 25 through the mutual fit between the holes 62 and projections 24*b* and, at the same time, the connecting shaft 60 is inserted into the holes 63 to thereby prevent the make-and-break shafts 24 against rotation. Also, one end 64*a* of the main spring 64 is caught on the connecting shaft 60.

In the above-mentioned make-and-break mechanism 23, as shown in FIG. 3, the component members of the mechanism 23 such as the operation handle 26, link lever 30, latch 34, link 36 and power transmission plate 40 are connected together by the handle shaft 31, pin 39 and U-shaped pin 43 and are thereby formed as a unit (operation portion) 65. On the other hand, the break-and-make shafts 24, main spring 64 and make-and-break lever 25 are integrally combined together and are thereby formed as another unit (make-and-break portion) 66. And, the operation portion 65, as shown in FIG. 2, is supported through the handle shaft 31 by a frame which is composed of the cover plate 27 and back plate 28; and, the frame is fitted with and fixed by the case 1 (FIG. 6). Also, the make-and-break portion. 66, as shown in FIG. 3, is rotatably supported through the small diameter portions of the make-and-break shafts 24 in a U-shaped bearing groove 67 formed in the case 1 (in FIG. 3, only part of the case 1 is shown) so as to open on the power source side. In this case, the other end 64*b* of the main spring 64, whose one end 64*a* is caught on the connecting shaft 60, is caught on the case 1, while the make-and-break lever 25 is energized in the direction of a solid arrow line shown in FIG. 3.

When the operation portion 65 and make-and-break portion 66 are assembled into the case 1 in the above-mentioned manner, as shown by a chained arrow line in FIG. 3, the power transmission shaft 46 is butted against the connecting shaft 60 so as to be perpendicular to the connecting shaft 60 and, in the shown on state of the make-and-break mechanism 23, the power transmission shaft 46 presses down the connecting shaft 60 against the main spring 64. FIG. 1 shows the whole structure of the make-and-break mechanism 23 held in such on state, whereas FIG. 2 shows only the operation portion 65 and make-and-break portion 66 of the make-and-break mechanism 23 held in the on state.

Figure 5A:
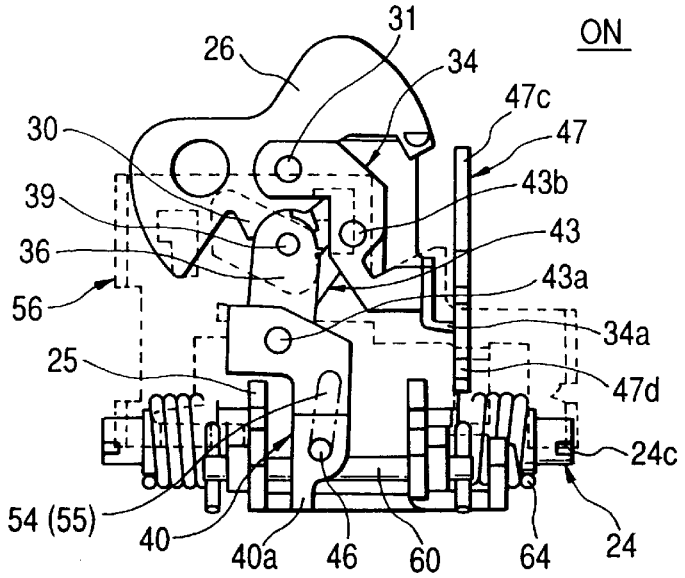
Figure 5B:
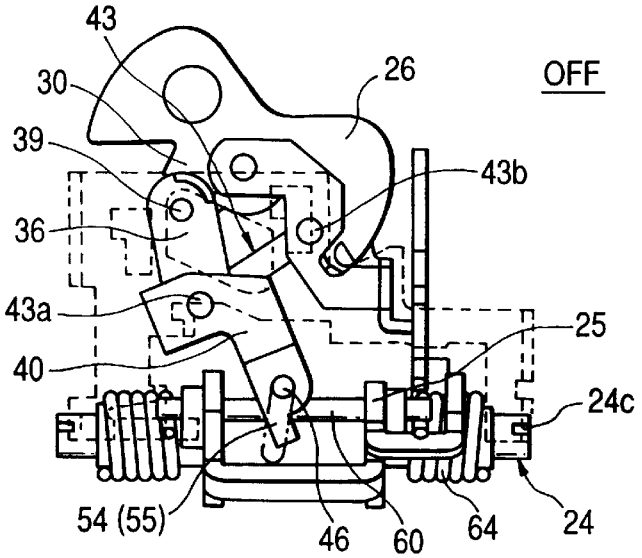
Figure 5C:
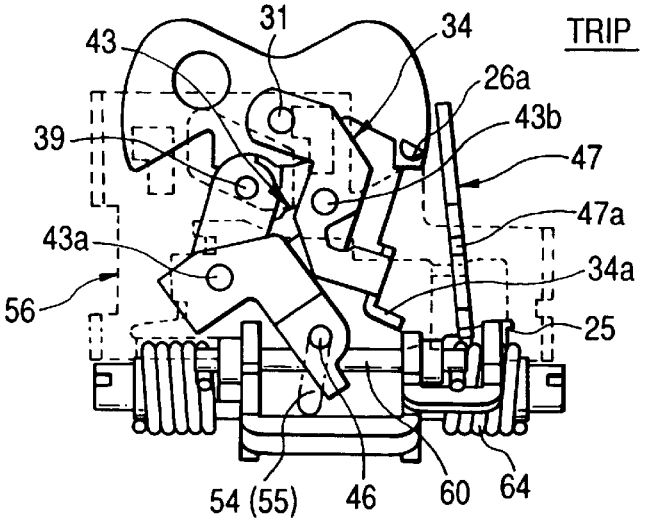
Figure 6:
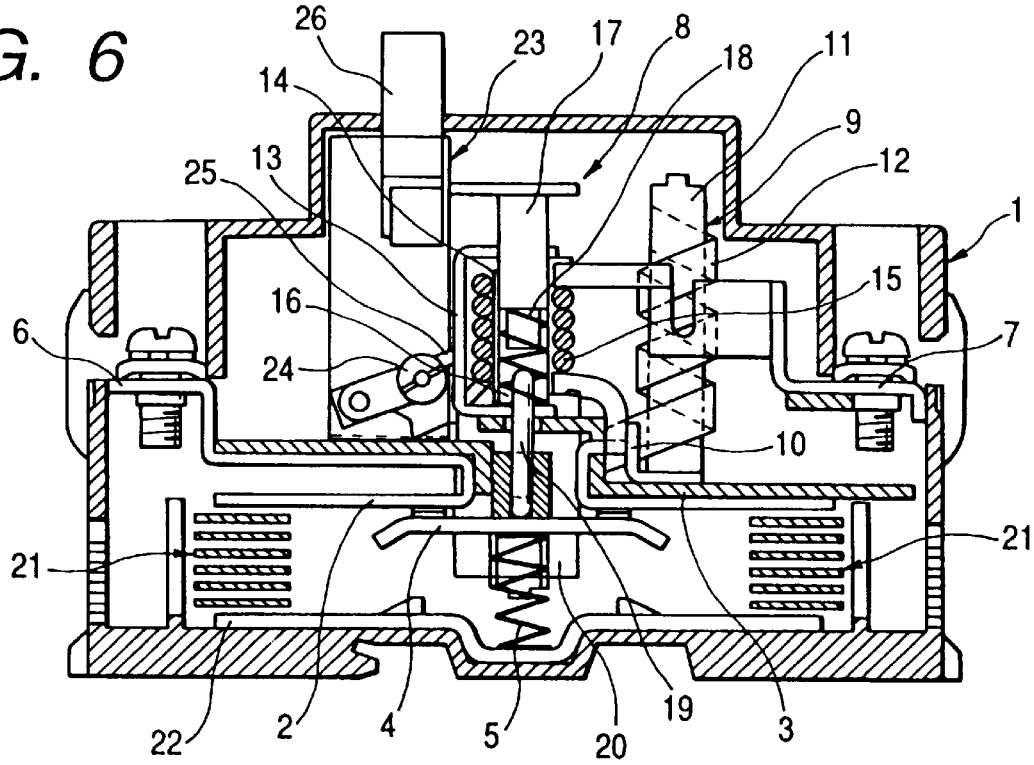
FIG. 6 is a longitudinal section view of a circuit breaker incorporating therein the make-and-break mechanism shown in FIG. 1.

Now, FIGS. 5A to 5C are side views of the main portions of the make-and-break mechanism 23, showing the operation of the make-and-break mechanism 23. Specifically, FIG. 5A shows the on state of the make-and-break mechanism 23, FIG. 5B shows the off state thereof, and FIG. 5C shows the trip state thereof. In FIG. 5A, the power transmission shaft 46, the operation of which is restricted within the elongated holes 54 and 55 (FIG. 4) of the cover plate 27 and back plate 28, presses down the connecting shaft 60 and the make-and-break lever 25 is rotated counterclockwise in FIG. 6 about the make-and-break shafts 24. Therefore, in FIG. 6, the movable contact member 4 is pressed against the fixed contact members 2 and 3 by the contact spring 5 to thereby close an electric circuit between them. At the then time, the main spring 64 is torsionally deformed to thereby store energy therein, so that the main spring 64 not only energizes the make-and-break lever 25 clockwise in FIG. 6 but also applies a force, which goes in the upward direction in FIGS. 5A to 5C, to the power transmission shaft 46 through the connecting shaft 60.

On the other hand, in FIG. 5A, because an axial line connecting together the pin 39 and the end portion 43*a* of the U-shaped pin 43 passes on the right of the handle shaft 31, the link 36, which receives a force from the main spring 64 through the power transmission plate 40, is held in the shown state where, while operating the operation handle 26 to rotate counterclockwise, the pin 39 butts against the right-side (in FIG. 4) end faces of the elongated holes 52 and 53 of the cover plate 27 and back plate 28 (see FIG. 2) and thus the pin 39 and link lever 30 cooperating together in forming the toggle device are arranged in an inverted dogleg shape. Also, in this state, the link 36 receives a force which goes clockwise with the pin 39 as the center thereof, so that the link 36 pulls the latch 34 through the U-shaped pin 43. For this reason, the latch 34 receives a force which is going to rotate it clockwise about the handle shaft 31. However, the pawl 34*a* is secured to the latch receiver 47, so that the latch 34 is held in the shown attitude.

From the on state shown in FIG. 5A, in case where the operation handle 26 is operated or rotated clockwise, at the time when the pin 39 passes through an axial line connecting together the handle shaft 31 and the end portion 43*a* of the U-shaped pin 43 from the right to the left, the operation of the main spring 64 with respect to the operation handle 26 is reversed and thus the operation handle 26 receives a clockwise-direction force from the main spring 64. Due to this, the link lever 30 and link 36 are bent in a dogleg shape to thereby raise the end portion 43*a* of the U-shaped pin 43 and, with the raising of the end portion 43*a*, the power transmission shaft 46 is moved upwardly along the elongated holes 54 and 55 to reach the off state shown in FIG. 5B. As a result of this, the make-and-break lever 25, which is released from the power transmission shaft 46, is suddenly driven or rotated clockwise in FIG. 6 due to the energy that is released by the main spring 64, thereby breaking the contact of the movable contact member 4 through the holder 20 to open the electric circuit between the fixed contact members 2 and 3. By the way, in FIG. 5B, the pin 39 is butted against the left-side (in FIG. 4) end faces of the elongated holes 52 and 53 and the operation handle 26 is held in the shown off attitude.

From the off state shown in FIG. 5B, in case where the operation handle 26 is operated or rotated counterclockwise, the U-shaped pin 43 is rotated counterclockwise about the end portion 43*b* thereof and, at the same time, link lever 30, link 36 and power transmission plate 40 are operated in linking with one another to thereby move down the power transmission shaft 46 along the elongated holes 54 and 55. Due to this, the make-and-break lever 25, while deforming the main spring 64 torsionally, is rotated counterclockwise in FIG. 6. The main spring 64 operates to push back the operation handle 26 up to an inverted position where the handle shaft 31, the pin 39 and the end portion 43*a* of the U-shaped pin 43 are aligned with one another; however, beyond the inverted position, an axial line connecting together the pin 39 and the end portion 43*a* of the U-shaped pin 43 passes on the right side of the handle shaft 31, so that the main spring 64 is stabilized in the on state shown in FIG. 5A. During this, in FIG. 6, the movable contact member 4 is moved upwardly due to the force of the contact spring 5 and is thus pressed against the fixed contact members 2 and 3 to thereby close the electric circuit between them. The rotational motion of the make-and-break shafts 24 in the above-mentioned on/off operations is transmitted as a mechanical signal to an external accessory (not shown) which is connected through a projecting strip member to the power transmission grooves 24*c* respectively formed in the end faces of the make-and-break shafts 24.

Now, FIG. 5C shows the trip state of the make-and-break mechanism. In case where, in FIG. 6, an overload current flows for a given period of time to thereby curve the bimetal 11 of the overcurrent detect device 9 by a given amount or more, or, a large current such as a short-circuit current flows to thereby attract the plunger 17 of the electromagnet device 8 in an instant, the operation end portion 47*c* of the latch receiver 47 is pushed in the left direction in FIG. 5A through a power transmission mechanism (not shown) and the latch receiver 47 is thereby rotated counterclockwise about the projecting shafts 47*a* thereof. Due to this, as shown in FIG. 5C, the latch 34 is removed from its secured condition held by the latch receiver 47 and is thereby rotated clockwise about the handle shaft 31.

As a result of this, the U-shaped pin 43 is rotated clockwise about the end portion 43*b* thereof and the end portion 43*a* thereof is thereby moved to the left in FIGS. 5A to 5C and, with the leftward movement of the end portion 43*a*, the power transmission shaft 46 is moved upwardly along the elongated holes 54, 55. Therefore, the connecting shaft 60 is released from the.power transmission shaft 46 and thus the make-and-break lever 25 is driven clockwise in FIG. 6 by the main spring 64 to thereby break the contact of the movable contact member 4, which in turn opens the circuit between the fixed contact members 2 and 3 (trip operation). By the way, in the circuit breaker shown in FIG. 6, in case where a large current flows and the plunger 17 is thereby attracted, prior to the above trip operation of the make-and-break mechanism, the movable contact member 4 is driven such that the contact of the movable contact member 4 is broken through the push rod 19. However, this is not directly related to the present invention and thus the description thereof is omitted here.

On the other hand, the operation handle 26, in the on state of the circuit breaker shown in FIG. 5A, receives through the pin 39 from the handle spring 59 (see FIG. 2) a force which acts in the obliquely downward direction in FIG. 5A. However, in case where the secured condition of the latch 47 is removed, the operation handle 26 is turned up to a position shown in FIG. 5C where the operation line of the handle spring 59 passes through the handle shaft 31, and thus the operation handle 26 is caused to stop in a trip display attitude which is almost horizontal. Here, in the on state of the circuit breaker shown in FIG. 5A, in case where the above trip operation occurs and thus the end portion 43*a* of the U-shaped pin 43 receives the force of the main spring 64 and is thereby moved in the left direction, the end portion 43*a* is butted against the butting piece 56*b* (FIG. 4) of the alarm output plate 56 shown by broken lines in FIGS. 5A to 5C to thereby move the alarm output plate 56 along the horizontal leg portion of the guide hole 57*a* horizontally in the left direction in FIG. 5A. This removes the engagement (FIG. 2) between the shoulder portion 57*a* of the guide hole 57 and the projection 27*a* of the handle spring 59 and thus the alarm output plate 56 is moved upwardly due to the spring force of the handle spring 59 until the lower end face of the alarm output plate 56 is contacted with the projection 27*a*. In this state, the alarm output plate 56 switches an alarm contact (not shown) through the output projecting portion 56*c* (FIG. 4) thereof and thus allows a trip signal to be issued to the outside. In this state, as shown in FIG. 5C, the projection 26*a* of the operation handle 26 is situated close to the upper end face of the alarm output plate 56.

Figure 7:
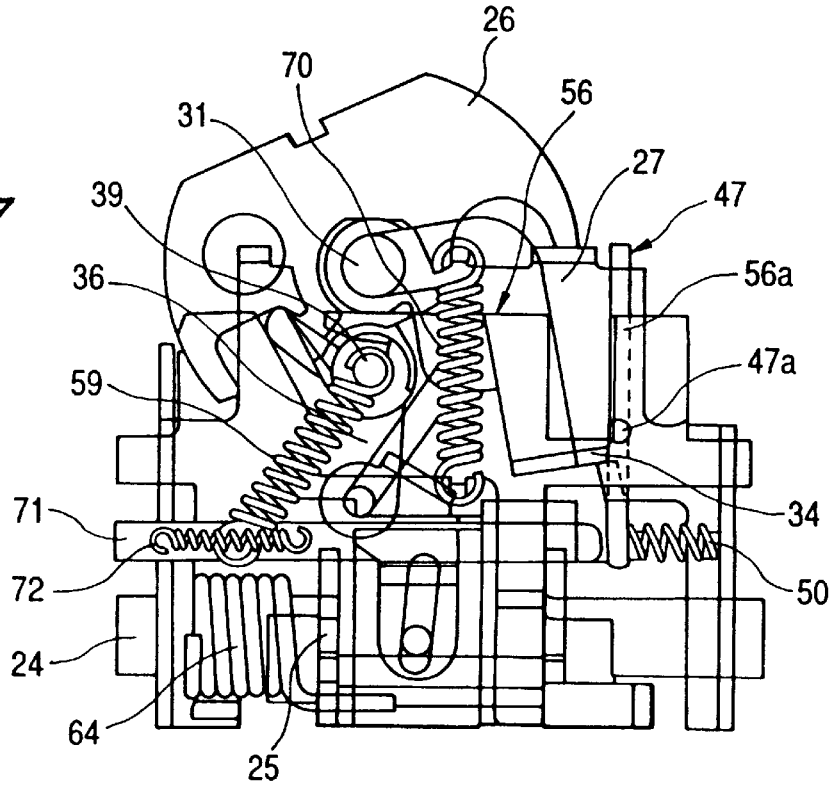
FIG. 7 PRIOR ART
FIG. 7 is a front view of a conventional make-and-break mechanism.

The alarm output plate 56 serves also as the conventional accessory linking plate 71 (FIG. 7). That is, as has been previously described, in case where the alarm output plate 56 is going to move upwardly along the guide hole 57 in a state that the latch 34 is secured by the latch receiver 47, the inclined surface of the power transmission portion 56*d* interferes with the connecting piece 47*d* of the latch receiver 47. At the then time, in case where the alarm output plate 56 is operated or slided in the transverse direction using a voltage trip device (not shown) to thereby remove the engagement between the shoulder portion 57*a* of the guide hole 57 and the engaging projection 27*d* of the cover plate 27, the alarm output plate 56, which is moving upwardly due to the spring force of the handle spring 59, pushes the connecting piece 47*d* of the latch receiver 47 through the inclined surface of the power transmission portion 56*d* thereof, so that the latch receiver 47 is rotated counterclockwise in FIG. 5A by the horizontal-direction component of the force applied to the connecting piece 47*d* of the latch receiver 47 from the inclined surface of the power transmission portion 56*d*. As a result of this, the secured condition of the latch 34 by the latch receiver 47 is removed to thereby break the contact of the movable contact member.

In the trip state shown in FIG. 5C, in order that the latch 34 can be secured again by the latch receiver 47 (reset operation), the operation handle 26 may be turned clockwise up to an off position shown in FIG. 5B. Due to this, the dogleg-curved link 36 and power transmission plate 40 are respectively stretched, simultaneously with such stretch, the latch 34 is raised up counterclockwise through the U-shaped pin 43 with the handle shaft 31 as a fulcrum thereof, and the pawl 34*a* pushes away the latch receiver 47 against the return spring 50 and is again engaged with the engaging portion 47*b* of the latch receiver 47, with the result that the make-and-break mechanism returns to the off state shown in FIG. 5B. Also, in this operation, the alarm output plate 56 is pressed down by the projection 26*a* of the operation handle 26 against the handle spring 59 and is thereby moved down along the vertical leg portion of the guide hole 57. Then, in case where the engaging projection 27*d* reaches the upper end of the guide hole 57, the engaging projection 27*d* is inserted into the horizontal leg portion of the guide hole 57 due to the lateral-direction component of the force given by the handle spring 59, so that the shoulder portion 57*a* and engaging projection 27*d* are engaged with each other again.

In the above-described make-and-break mechanism, the alarm output plate 56 is secured to the cover plate 27 through the engaging projection 27*d* of the cover plate 27 and, in the trip operation of the make-and-break mechanism, the secured condition of the alarm output plate 56 is removed through the U-shaped pin 34 due to the stored energy of the main spring 64 and thus the alarm output plate 56 is moved upwardly due to the spring force of the handle spring 59. Therefore, since the latch receiver 47 is free from a load necessary for securing the alarm output plate 56, in the trip operation, the load force of the overcurrent detect portion necessary to drive or rotate the latch receiver 47 can be reduced over the conventional make-and-break mechanism. Also, in the trip operation, because the upward movement of the alarm output plate 56 is carried out by the handle spring 59 which is used to rotate the operation handle 26 to the trip display position, there is eliminated the use of the conventional output plate spring 70 (FIG. 7).

Further, the alarm output plate 56 serves also as the accessory linking plate 71 (FIG. 7), in case where the alarm output plate 56 is operated or slid laterally by the voltage trip device and the secured condition of the alarm output plate 56 by the engaging projection 27*d* is thereby removed, the alarm output plate 56 is moved upwardly due to the spring force of the handle spring 59, the power transmission portion 56*d* of the alarm output plate 56 interferes with the linking piece 47*d* of the latch receiver 47 to thereby operate or rotate the latch receiver 47, so that the secured condition of the latch 34 is removed to thereby break the circuit breaker. This eliminates the provision of the conventional accessory linking plate 71 and return spring 72 for the accessory linking plate 71 (FIG. 7).

As has been described heretofore, according to the invention, by securing the alarm output plate to the frame of the make-and-break mechanism to thereby hold the alarm output plate at the wait position, the load applied to the latch receiver can be relieved and thus the load force of the overcurrent detect portion of the make-and-break mechanism can be reduced, so that the make-and-break mechanism can be reduced in size and the trip characteristic of the make-and-break mechanism can be stabilized. At the same time, the alarm output plate serves also as the accessory linking plate of the voltage trip device; and, the handle spring serves also as the output spring of the alarm output plate as well as the return spring of the accessory linking plate. Therefore, the conventionally used accessory linking plate, output spring and return spring can be omitted, which in turn makes it possible to simplify the structure of the make-and-break mechanism.

What is claimed is:

1. A make-and-break mechanism for use in a circuit breaker comprising:

an operation handle rotatably supported on a frame composed of a cover plate and a back plate through a handle shaft;

a make-and-break lever rotatably supported on a case through a make-and-break shaft and energized in one direction by a main spring; a mechanism member for transmitting the operation of said operation handle to said make-and-break. lever;

a latch having one end connected to said operation handle through said handle shaft;

a U-shaped pin disposed so as to bridge over said latch and said mechanism member; and a latch receiver rotatably supported on said frame and, when said make-and-break mechanism is held in the on state, capable of securing the other end of said latch, wherein, in case where the secured condition of said latch by said latch receiver is removed due to the operation of an overcurrent detect portion of said make-and-break mechanism, said make-and-break lever is driven to an off position due to the stored energy of said main spring to thereby break the contact of a movable contact member, and, during this operation, in case where the secured condition of said latch is removed, an alarm output plate, which is disposed in said make-and-break mechanism so as to be slidable along said cover plate, is driven or moved in the upward direction from a wait position to operate an alarm contact;

wherein, in said cover plate, there are provided a pair of right and left engaging projections and, in said alarm output plate, there are formed inverted-L-shaped guide holes which can be slidably fitted with said engaging projections; between a pin for connecting said operation handle to said mechanism member and said alarm output plate, there is provided a handle spring composed of a tension spring; in the on/off state of said make-and-break mechanism, the shoulder portions of said guide holes are engaged with said engaging projections to thereby hold said alarm output plate at a wait position; and, in the on state of said make-and-break mechanism, in case where the secured condition of said latch is removed, said alarm output plate is pushed by said U-shaped pin operatable in linking with said latch to thereby remove said engagement, whereby said alarm output plate is moved in the upward direction along said guide holes due to the spring force of said handle spring and, at the same time, said operation handle is rotated to a trip display position.

2. A make-and-break mechanism for use in a circuit breaker as set forth in claim 1, wherein, in said operation handle, there is provided a projection opposed to the upper end face of said alarm output plate, said operation handle rotated to said trip display position is operated or rotated to an off position to thereby engage said latch with said latch receiver again and, during this operation, said alarm output plate is pressed down by said projection to thereby engage said alarm output plate with said engaging projections again.

3. A make-and-break mechanism for use in a circuit breaker as set forth in claim 1, wherein, in said latch receiver, there is provided a linking piece projecting in the lateral direction; in said alarm output plate, there is formed a power transmission portion which, in case where said alarm output plate is moved in the upward direction along said guide holes with said latch receiver securing said latch, interferes with said linking piece of said latch receiver through the inclined surface of said power transmission portion; and, by operating or sliding said alarm output plate in the lateral direction using a voltage trip device to thereby remove said engagement, said linking piece of said latch receiver is pushed by said alarm output plate moving upwardly due to the spring force of said handle spring through the inclined surface of said power transmission portion, whereby the secured condition of said latch by said latch receiver is removed to thereby break the contact of a movable contact member.

* * * * *

UNITED STATES PATENT AND TRADEMARK OFFICE

CERTIFICATE OF CORRECTION

PATENT NO. : 6,229,414 B1 
DATED : May 8, 2001
INVENTOR(S) : Kentaro Toyama et al.

It is certified that error appears in the above-identified patent and that said Letters Patent is hereby corrected as shown below:

Title page,
After Item [22], please insert:
-- [30] Foreign Application Priority Data
August 4, 1999 (JP) ……. Hei. 11-220631 --

Signed and Sealed this

Thirteenth Day of July, 2004

JON W. DUDAS
*Acting Director of the United States Patent and Trademark Office*